US007222443B2

(12) United States Patent
Mitchell

(10) Patent No.: US 7,222,443 B2
(45) Date of Patent: May 29, 2007

(54) FOOTWEAR WITH IMPROVED INSOLE

(75) Inventor: David P. Mitchell, Clarksville, TN (US)

(73) Assignee: Rocky Brands Wholesale LLC, Nelsonville, OH (US)

( * ) Notice: Subject to any disclaimer, the term of this patent is extended or adjusted under 35 U.S.C. 154(b) by 260 days.

(21) Appl. No.: 10/799,395

(22) Filed: Mar. 11, 2004

(65) Prior Publication Data

US 2005/0198865 A1 Sep. 15, 2005

(51) Int. Cl.
*A43B 13/20* (2006.01)

(52) U.S. Cl. ..... 36/30 R; 36/28; 36/25 R; 36/30 A; 36/31

(58) Field of Classification Search ..... 36/30 A, 36/3 R, 31, 25 R, 43, 44, 28, 29, 12, 37, 36/88, 92
See application file for complete search history.

(56) References Cited

U.S. PATENT DOCUMENTS 2,144,330 A 1/1939 Farrington
2,809,450 A 10/1957 Stritler
5,105,564 A 4/1992 Motoda
5,369,896 A * 12/1994 Frachey et al. ..... 36/29
6,041,521 A * 3/2000 Wong ..... 36/28
6,145,220 A * 11/2000 Johnson et al. ..... 36/34 R
6,321,464 B1 11/2001 Oberg et al.
6,519,874 B1 * 2/2003 Dean ..... 36/30 R
6,691,432 B2 * 2/2004 Masseron ..... 36/28
6,711,836 B2 * 3/2004 Weiss ..... 36/136
6,796,056 B2 * 9/2004 Swigart ..... 36/29
6,912,801 B2 * 7/2005 Oberg et al. ..... 36/30 R

FOREIGN PATENT DOCUMENTS

WO WO 93/12685 A1 * 7/1993
WO WO 95/00047 A1 * 1/1995

* cited by examiner

*Primary Examiner*—Marie Patterson
(74) *Attorney, Agent, or Firm*—Porter Wright Morris & Arthur LLP

(57) ABSTRACT

Footwear includes an insole with at least one covered opening in the insole.

5 Claims, 10 Drawing Sheets

42
43
44
46
48
50
52
54
56

FOOTWEAR WITH IMPROVED INSOLE

CROSS-REFERENCE TO RELATED APPLICATIONS

There are no related applications.

STATEMENTS AS TO RIGHTS TO INVENTION MADE UNDER FEDERALLY SPONSORED RESEARCH AND DEVELOPMENT

The invention disclosed and claimed herein was not made under any federally sponsored research and development program.

A. BACKGROUND OF THE INVENTION

1. Field of the Invention

This invention relates to footwear and more specifically to footwear having an improved insole.

2. Brief Description of the Prior Art

It is known in the prior art to produce footwear by the lasting process. In one type of lasting, referred to in the industry as flat lasting, an upper is placed on a last and the end portion of the upper is tightened around the periphery of the insole and cemented to the bottom of the insole. The insole provides a platform during this lasting process and it must be of sufficient thickness, rigidity and strength to withstand the force of the upper end portion as it is tightened around the periphery of the insole and cemented to the insole bottom. At the same time, it is desirable that the insole be light and flexible. There have been various approaches to providing improved insoles for use in such footwear lasting including, for example, the insoles disclosed in U.S. Pat. Nos. 2,144,340; 2,809,450; and 5,105,564.

After the upper and insole are lasted, an outsole is attached to the insole by molding the outsole to the insole, or by other means, and the last is removed from the completed shoe. Other intermediate steps that may occur during the lasting process include softening the upper in a heat chamber, forming a box toe, and trimming excess cement from the bottom of the insole.

It is also known in the prior art to include a cushioned insert on an insole to provide cushioning for the wearer of the footwear. In one such prior art footwear sold by Georgia Boot Inc., (the predecessor of the assignee of the present invention) under the name "Comfort Core Welt", a bottom extension on a cushioned insert was inserted into an opening in the insole. This footwear was produced by a lasting method known as the welt lasting method and the footwear included an outsole which was cemented to the footwear.

In the past, footwear outsoles were formed of light weight blown polyurethane material. However, no such footwear which included an insole having an opening therein included a polyurethane outsole. It is believed that the reason such otherwise desirable light weight polyurethane outsoles were not used with insoles having openings therein, was because an objectionable amount of polyurethane would enter the footwear through the openings in the insole when the polyurethane formed the outsole.

B. SUMMARY OF THE INVENTION

An insole having one or more openings is provided for use with an outsole formed of blown material such as polyurethane. To prevent an objectionable amount of blown material from entering the footwear, the openings in the insole are covered with expandable material. The expandable material covering the openings expands to receive the bottom extension of a cushioned insert. For purposes of illustration, a cushioned insert such as disclosed in U.S. Pat. No. 6,321,464 (see, insole 15) is described herein. It is expressly noted, however, that cushioned inserts having different bottom extensions than that disclosed in the aforementioned patent are within the scope of the present invention.

The insole of the present invention is of sufficient thickness, rigidity and strength to enable it to be used in the lasting process. The insole of the present invention is not, however, limited to its use in the lasting process and it may be used in footwear produced by processes other than by the lasting process.

In order to receive the bottom extension of a cushioned insert such as disclosed in U.S. Pat. No. 6,321,464, a forepart section of the insole includes an inner portion of expandable material covering an opening in the forepart section. The expandable material is attached to a relatively rigid peripheral outer portion of the forepart section. Similarly, the backpart section of the insole also includes an inner portion of expandable material covering an opening. The expandable material of the backpart section is attached to a relatively rigid peripheral outer portion of the backpart section. The expandable material of the forepart section and the expandable material of the backpart section limit the amount of blown material that will enter the footwear during the outsole forming process to an acceptable level.

Accordingly, it is an object of this invention to provide footwear with an improved insole; and It is a further object of this invention to provide footwear with an improved insole having at least one covered opening therein to limit the amount of blown material utilized to form the outsole from entering the footwear.

Other objects and attendant advantages of this invention will be readily appreciated as the same becomes more clearly understood by references to the following detailed description when considered in connection with the accompanying drawings in which like reference numerals designate like parts throughout the figures thereof.

C. BRIEF DESCRIPTION OF THE DRAWINGS

D. DETAILED DESCRIPTION OF THE PREFERRED EMBODIMENTS

Figure 1:
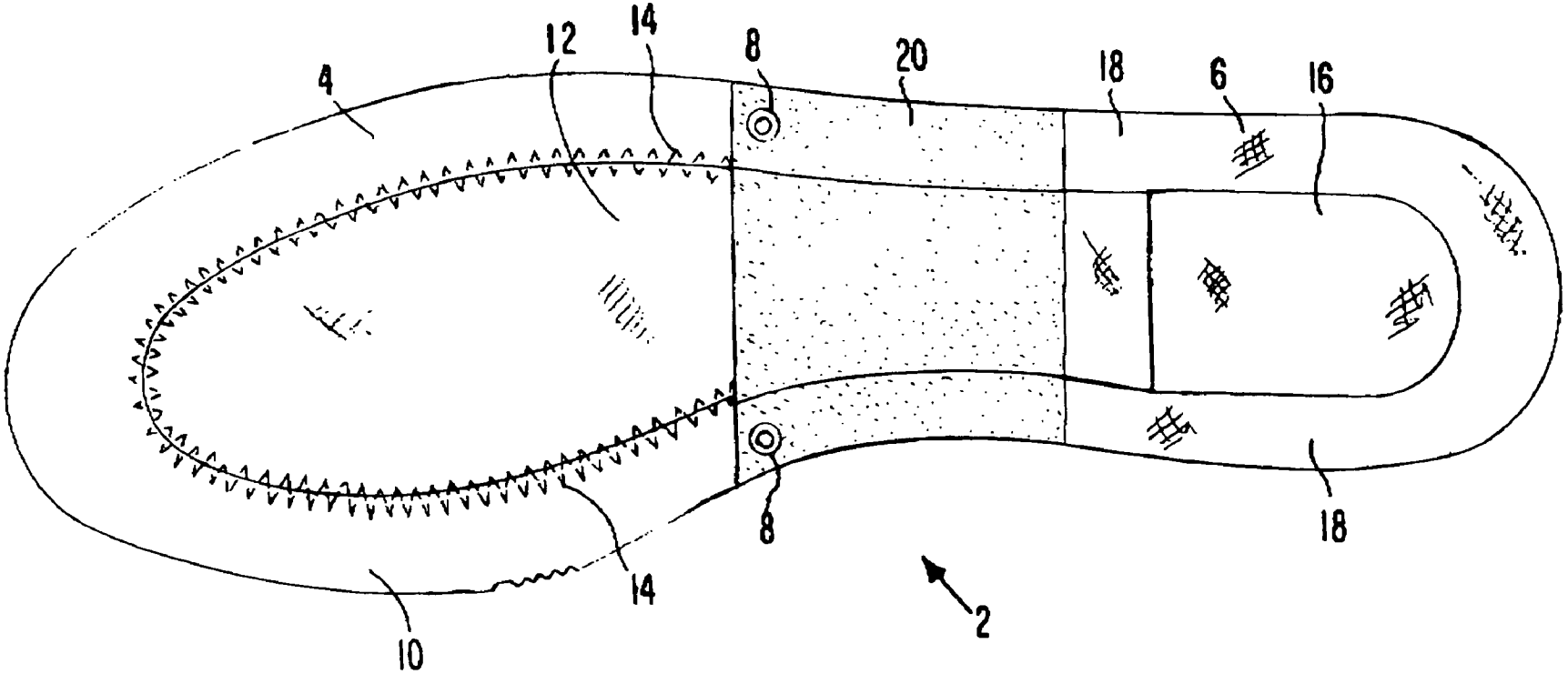
FIG. 1 is a top plan view of the insole of the present invention.

For a fuller understanding of the nature and objects of the invention, reference should be had to the following detailed description taken in connection with the accompanying drawing forming a part of this specification and in which similar numerals of reference indicate corresponding parts in all the figures of the drawing.

Figure 2:
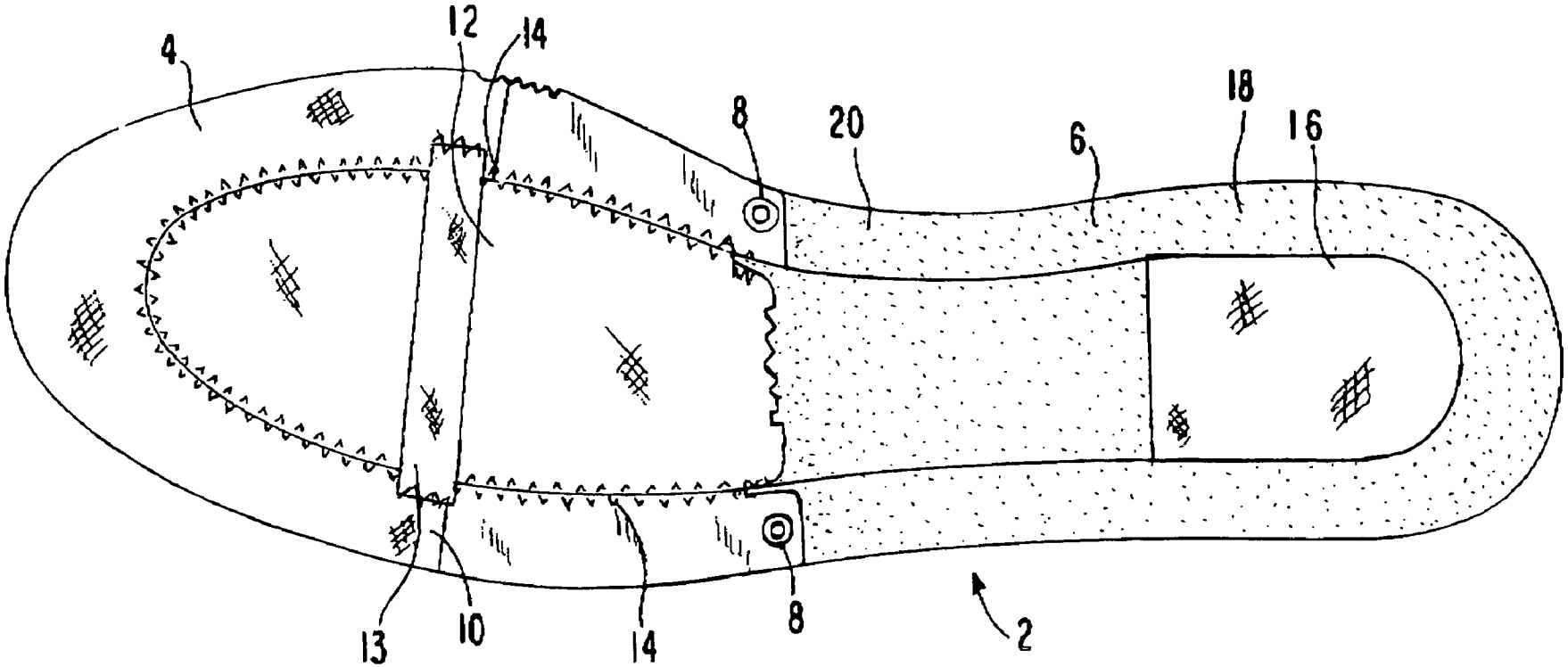
FIG. 2 is a bottom plan view of the insole of the present invention.
Figure 3:
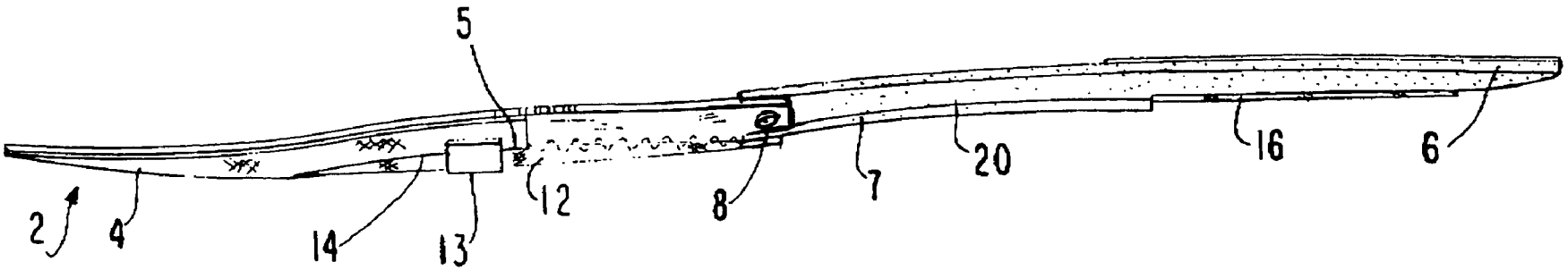
FIG. 3 is a side elevational view of the insole of the present invention.

With reference to FIGS. 1, 2, and 3 there is shown an insole 2 including a forepart section 4 and a backpart section 6. The forepart section 4 and backpart section 6 may be secured together by rivets 8. The forepart portion 4 includes a shaped bottom 5 (see FIG. 3) and comprises a relatively rigid peripheral outer portion 10 formed of fiberboard or other firm, yet flexible, insole material. Outer portion 10 surrounds an inner portion 12 formed of expandable material, such as the stretchable fabric sold by Invista Inc., under the registered trademark "LYCRA." The fiberboard may be the type sold by Texon International, under the trademark "TEXON." The peripheral outer portion 10 and the inner portion 12 may be secured together by zigzag stitching 14 and/or cement.

The backpart portion 6, includes a shaped bottom 7 (see FIG. 3) and may be formed of relatively hard fiberboard or thermoplastic. A strip 13 of cloth material extending across and attached to the peripheral outer portion 10 by zigzag stitching, assists in preventing insole 2 from spreading apart during the lasting process. Backpart portion 6 which may be a thermoplastic urethane includes expandable material 16 in the heel area which may also be "LYCRA" stretchable fabric. The periphery 18 of expandable material 16 is secured to the backpart portion 6 by adhesive. Backpart portion 6 includes an integral stiff shank 20 for supporting the arch.

Figure 4:
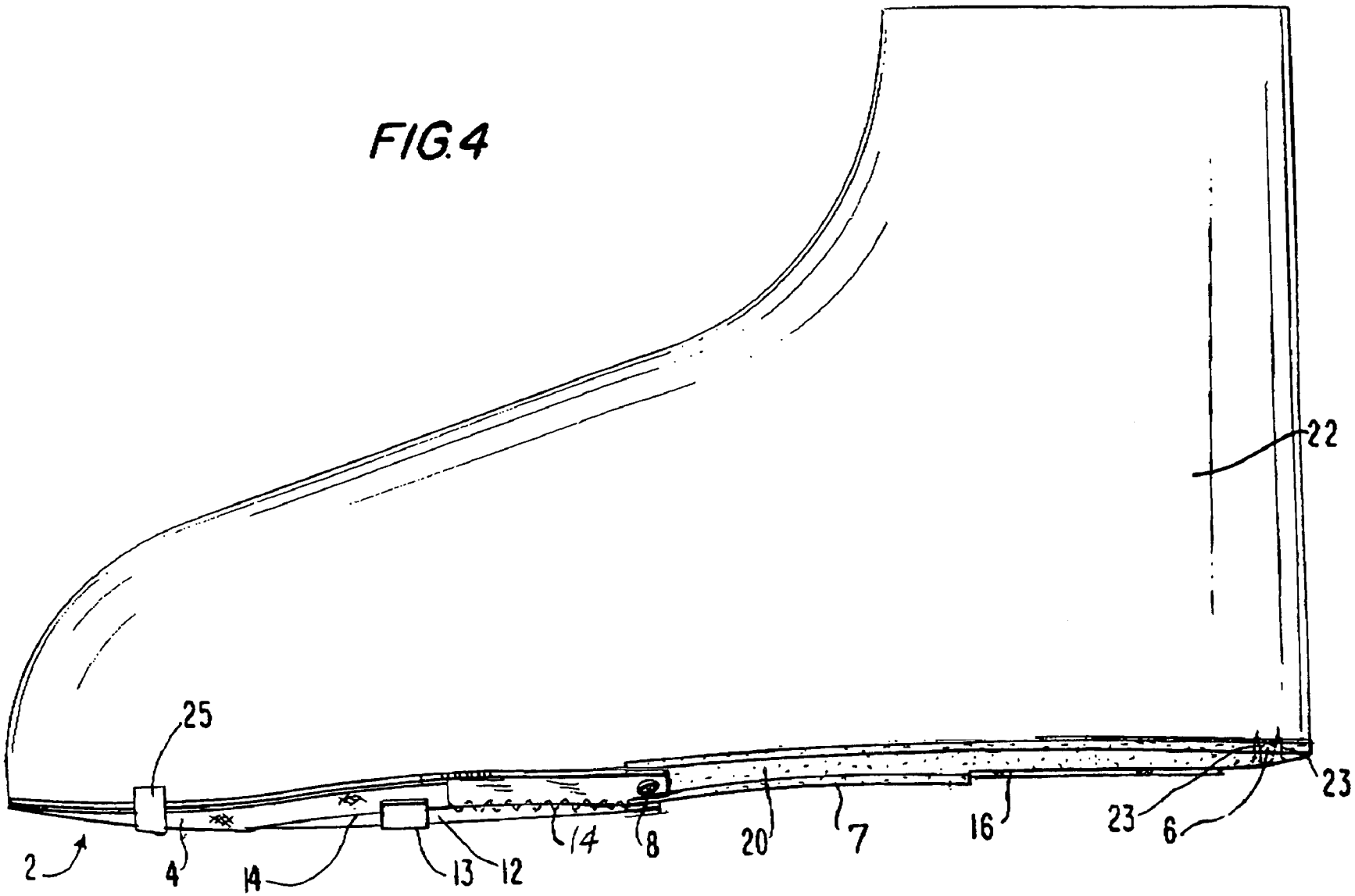
FIG. 4 is a left side elevational view of the insole of the present invention attached to a last for forming the upper and insole.
Figure 5:
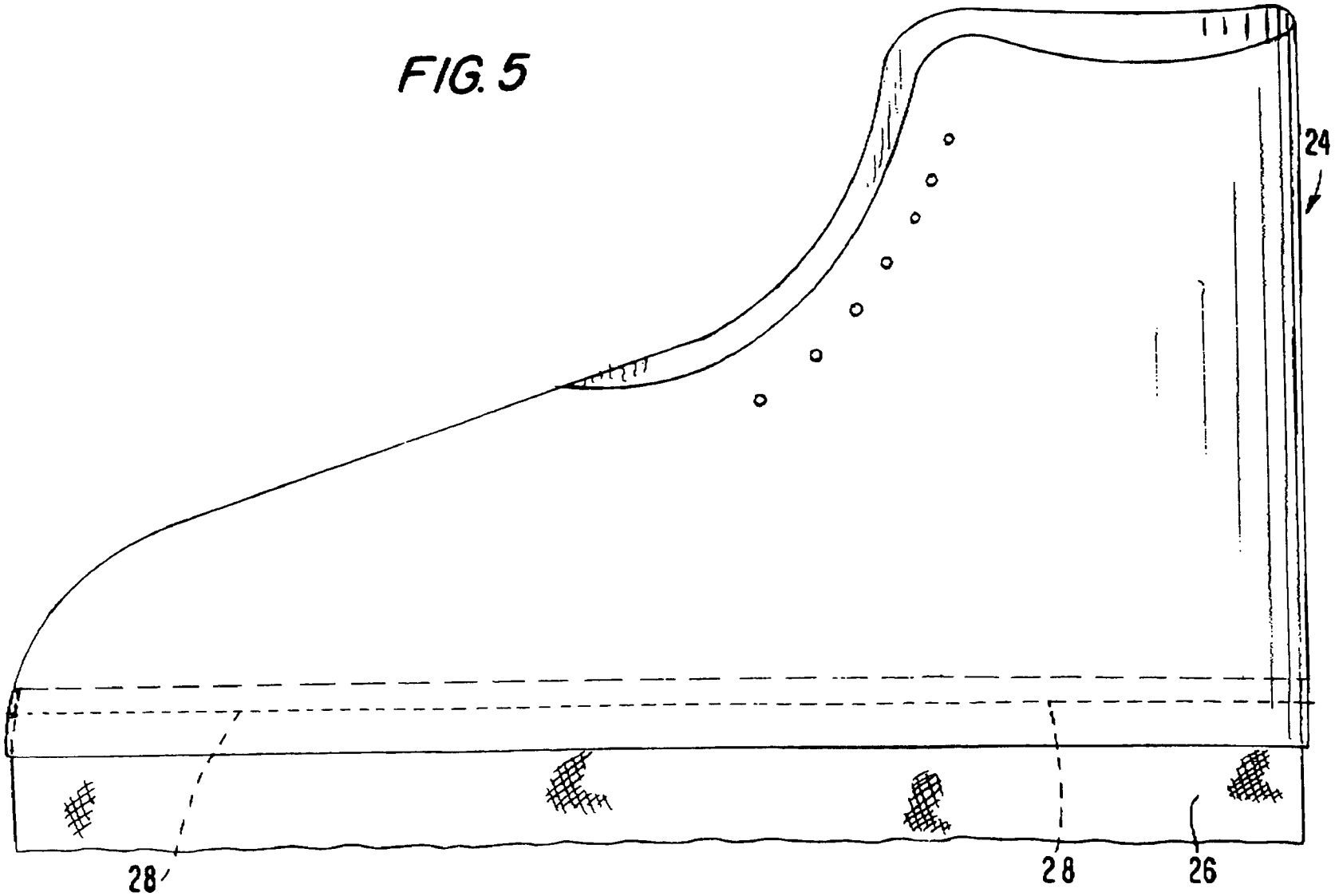
FIG. 5 is a left side elevational view of the upper.

The manner in which the insole 2 of the present invention is utilized in a footwear lasting process is next described. With reference to FIG. 4, it is seen that insole 2 is secured to last 22, which may be plastic, by known means such as tacking the backpart section 6 to the bottom of last 22 with tacks 23, and taping the forepart portion 4 to the bottom of last 22 by tape 25. Upper 24 shown in FIG. 5 includes an end portion or lasting allowance 26 which is a fabric formed of strong, durable and flexible material such as nylon. Lasting allowance 26 extends below upper 24 and is attached to the inside of the upper 24 by stitching 28.

Last 22, including insole 2, is inserted into upper 24 so that insole 2 extends through the opening at the bottom of upper 24. If the boot is to include a box toe, upper 24 may be placed in a steamer to first soften the leather. Then the box toe may be inserted between the vamp and upper, and a toe box machine may apply heat and pressure to the toe box in known manner.

In the lasting process, the lasting allowance 26 of upper 24 is tightened around and beneath the periphery of insole 2 and is cemented into engagement thereto in known manner. A protective piece of foam, sponge type material may be placed on top of the upper to prevent scraping, scarring or discoloration of the leather when an upper clamp is pressed against the leather during the lasting process. Further, as is well known in the art, the sides of the lasting allowance 26 may be hand lasted to the sides of the insole 2. Any excess glue remaining on the bottom of insole 2 after the lasting process is scraped off so that the wearer of the footwear does not feel any uncomfortable bulges when wearing the footwear.

Figure 6A:
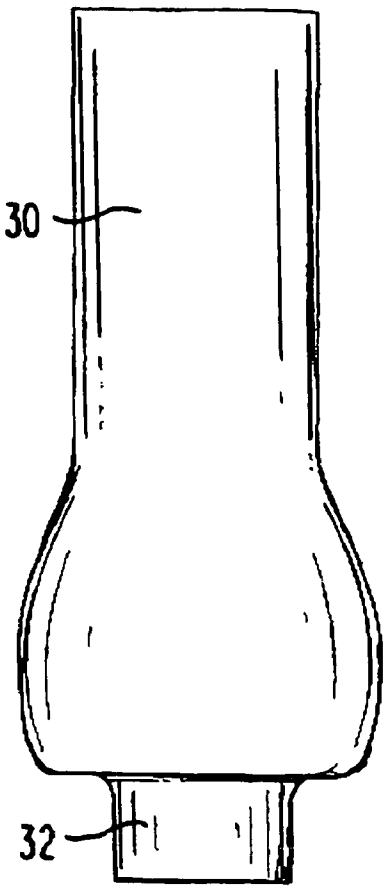
FIG. 6A is a rear elevational view of the last for forming the outsole.
Figure 6:
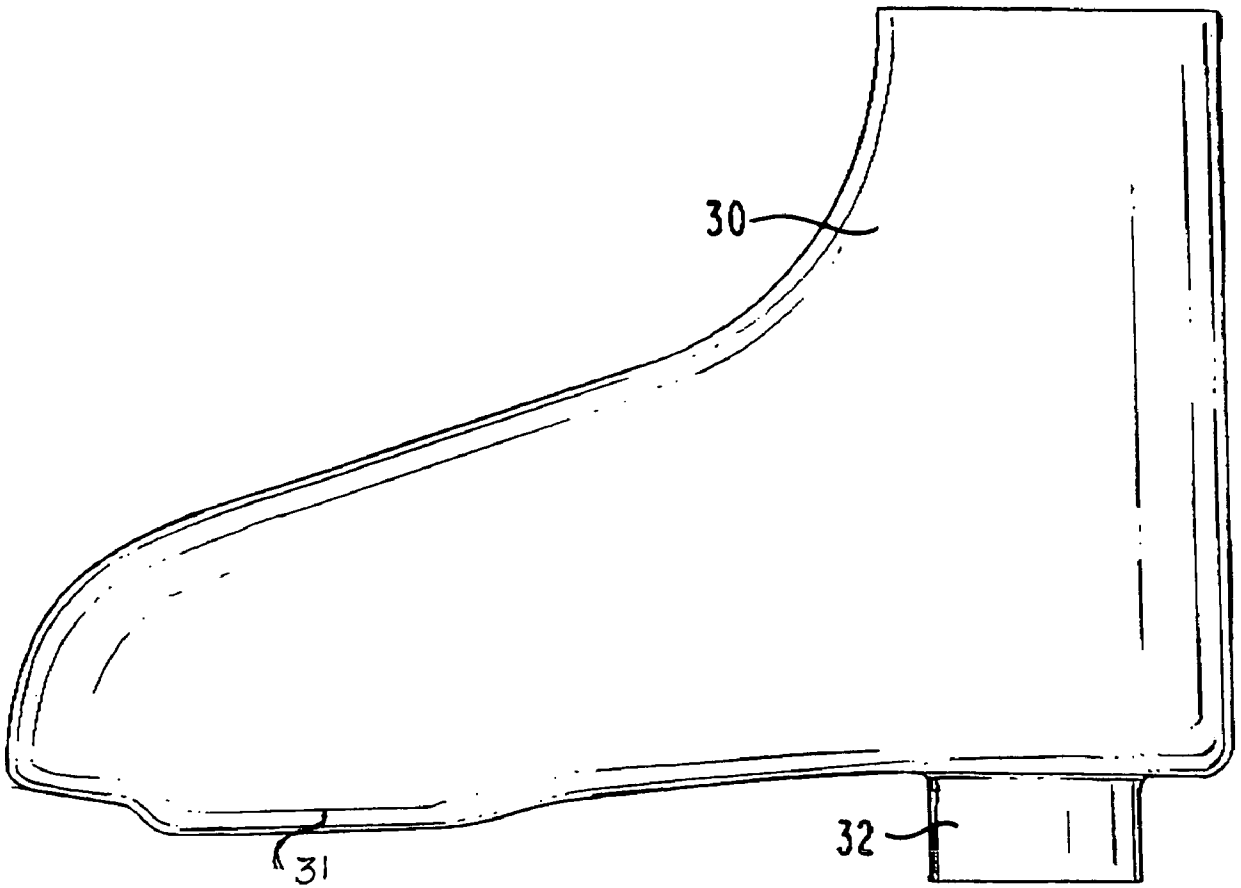
FIG. 6 is a left side elevational view of the last for forming the outsole.

Last 22 is then removed from the upper 22 and upper 22 with the insole lasted thereto is placed over a second last 30 shown in FIGS. 6A and 6B. Last 30, which may be metallic, is known in the industry as a foot form, and includes forepart extension 31 and a heel extension 32. The upper 24 is placed over last 30 so that forepart extension 31 of last 30 is inserted into the expandable material 12 and heel extension 32 of last 30 is inserted into the expandable material 16 of insole 2. In this manner expandable material 12 expands to the shape of forepart extension 31 and expandable material 16 expands to the shape of heel extension 32.

Figure 7:
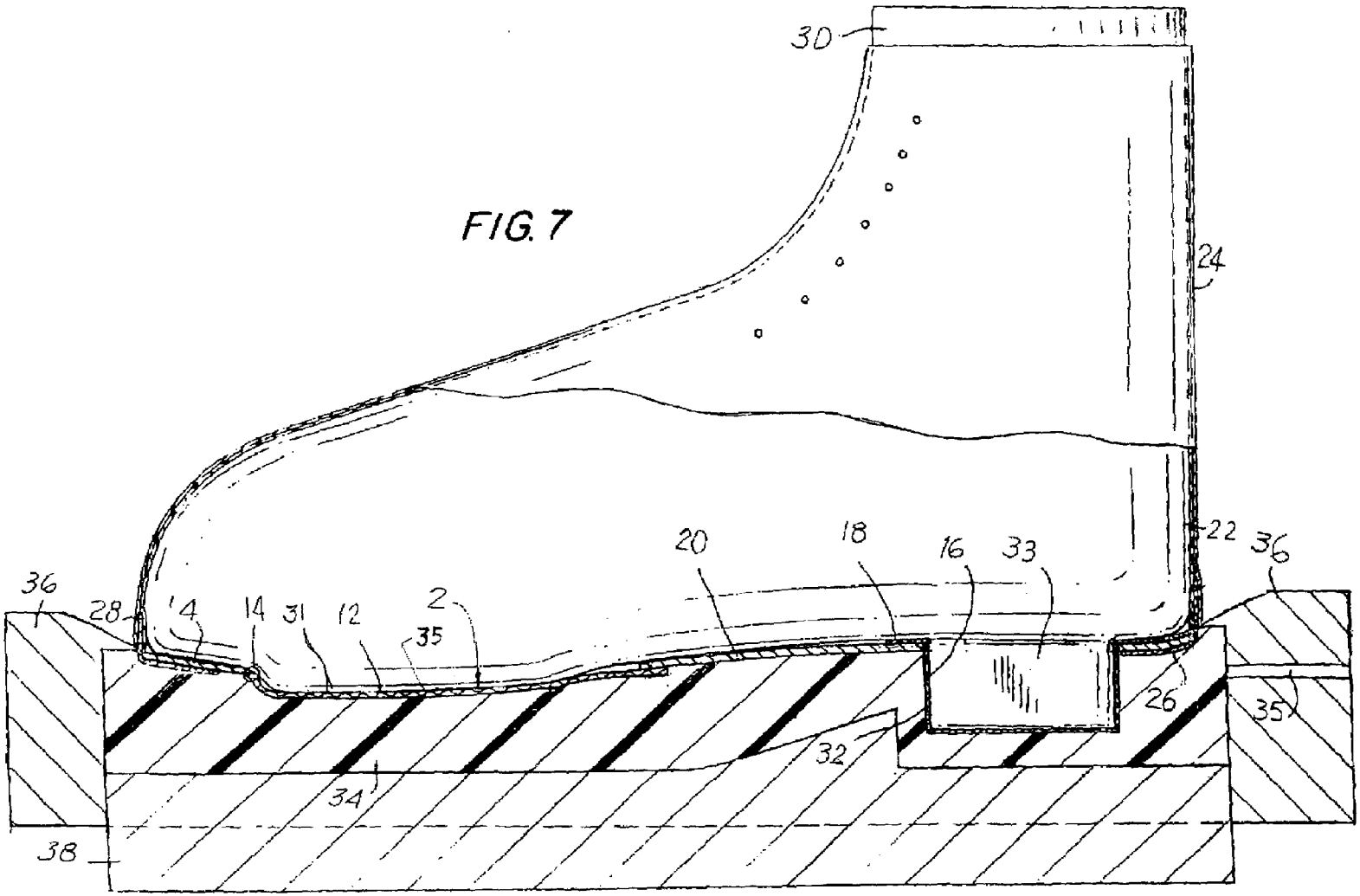
FIG. 7 is a left side sectional view of the last for forming the outsole, the upper and insole, the mold for forming the outsole and the outsole which has been formed.
Figure 8:
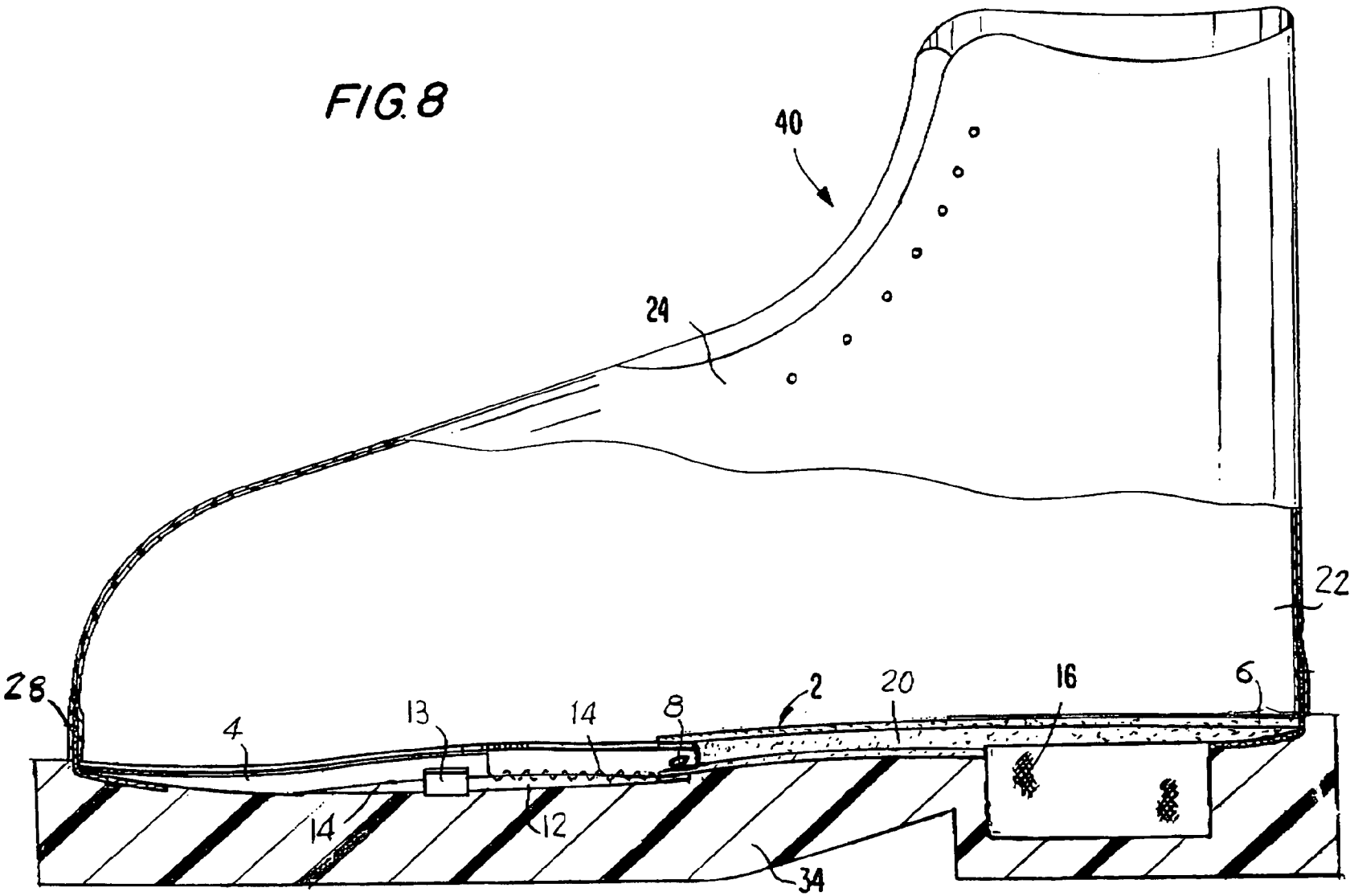
FIG. 8 is a left side elevational view of the footwear produced by the present invention.

In FIG. 7, the drawing is sectioned to show forepart extension 31 inserted in expandable material 12 and heel extension 32 inserted in expandable material 16. Last 30 is seated on sole frame 36 and sole plate 38, is moved upwardly so that the top of the sole plate 38 is in contact with the bottom of upper 24. The material from which the outsole 34 is formed, which may, for example, be polyurethane, is injected into hollow cavity 35, in the sole plate 38 to form the outsole 34.

The forepart extension 31 of last 30 creates the corresponding forepart depression 35 in outsole 34 and the heel extension 32 of last 30 creates the heel opening 33 in outsole 34. It will be appreciated that expandable material 12 and expandable material 16 will limit the amount of injected polyurethane that may seep into footwear 40. When the outsole 34 is formed, the formed footwear 40 is removed from sole frame 36 and is removed from the last 30. Expandable material 12 and expandable material 16 will remain fixed in their expanded state.

Figures 9, 9A, 9B:
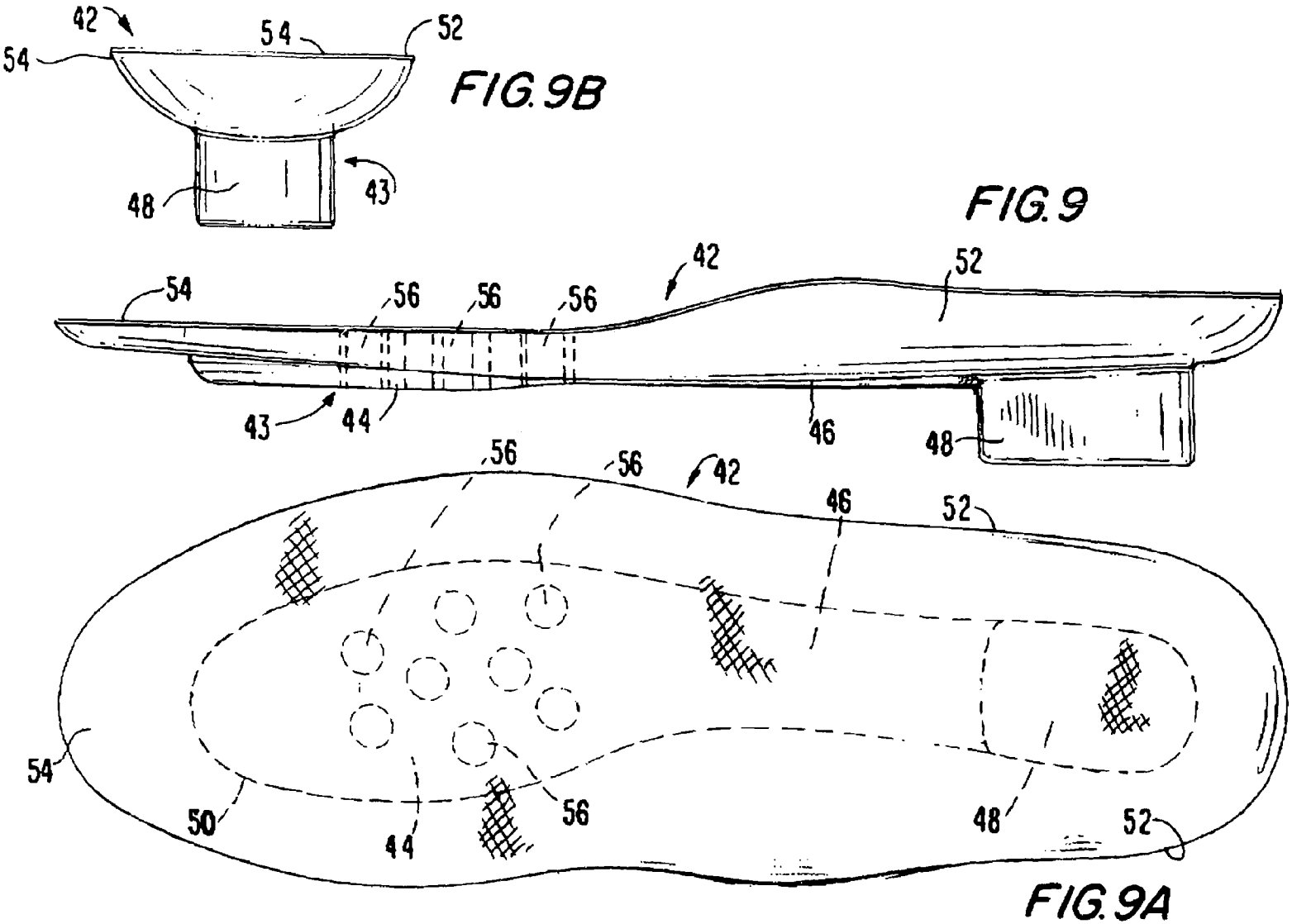
FIG. 9 is a left side elevational view of a cushioned insole for use in the footwear produced by the present invention.
FIG. 9A is a top plan view of the cushioned insole shown in FIG. 8.
FIG. 9B is a rear elevational view of the cushioned insole shown in FIG. 8.

Footwear 40 includes cushioned insert 42 shown in FIGS. 9, 9A and 9B which is of the type disclosed in U.S. Pat. No. 6,321,464, but, as previously noted, other cushioned inserts having other bottom extensions are also contemplated by the present invention. Cushioned insert 42 may be separately molded from polyurethane. A bottom extension 43 of cushioned insert 42 includes a front portion 44, an intermediate portion 46 and a heel portion 48. The bottom extension 43 is configured to fit on top of insole 2. The upper portion 50 of cushioned insert 42 includes contoured surfaces 52 to accommodate the wearer's foot. The top surface of cushioned insert 42 includes a thin layer of fabric 54 or other suitable lining material along its entire surface, only a section of which is shown in FIG. 9A. Holes 56 are provided in cushioned insert 42 to assist in maintaining the wearer's feet in a cool and dry condition.

Figure 10:
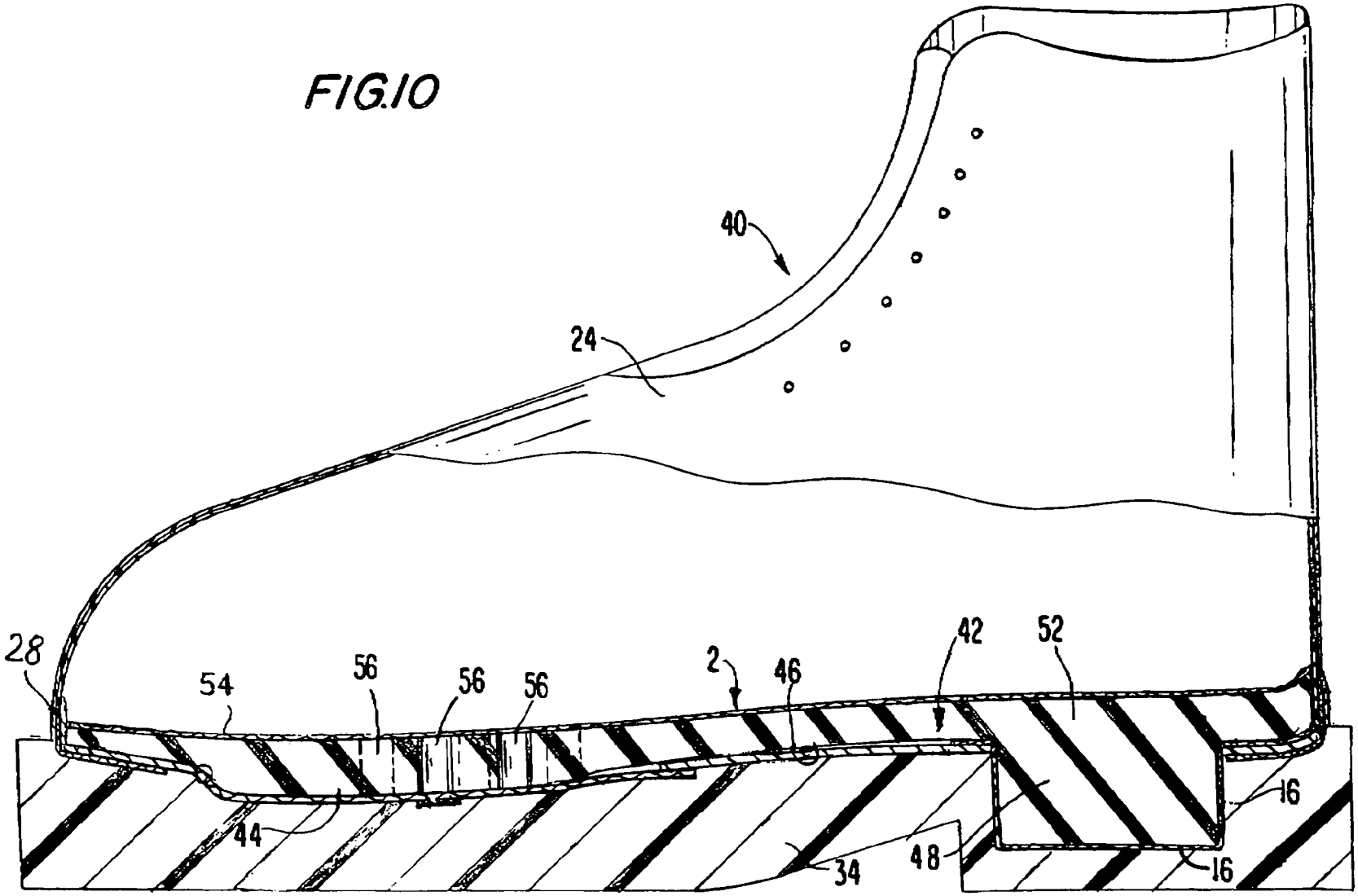
FIG. 10 is a left side sectional elevational view of the footwear produced by the present invention including the cushioned insole.

In FIG. 10, it is seen that the front portion 44 of cushioned insert 42 overlies the forepart portion 4 of insole 2, the lower intermediate portion 46 of insert 42 overlies the shank 20, and the heel portion 48 is received within expandable material 16, in its expanded position, and fits within heel opening 33 in outsole 34.

This invention has been described above with reference to presently preferred embodiments of the invention; such description has not been presented as a catalog exhaustive of all forms which this invention may take. Accordingly, workers skilled in the art to which this invention pertains will readily appreciate that variations, alterations or modifications in the structures, procedures, and arrangements described above may be practiced without departing from the scope of this invention. Thus, the foregoing description should not be read as limiting the scope of this invention to less than the fair scope of the invention.

I claim:

1. An article of footwear comprising:

an insole comprising a fore part and a rear part, the fore part and rear part each comprising a rigid periphery attached to a central area of stretchable material;

an upper having a lower edge attached to the insole periphery;

an outsole attached to at least a portion of the insole periphery, the outsole having an upper surface defining at least one depression in a position underlying the stretchable material;

a cushioned insert having at least one extension from its lower surface in a position corresponding to a depression in the upper outsole surface, the extension deforming the stretchable material overlying that depression such that the extension is receivable within the depression.

2. The article of claim 1, wherein the extension on said cushioned insert comprises a heel portion.

3. The article of claim 1, wherein the outsole is injection molded and the at least one depression is formed by a last positioned against the upper insole surface with at least one portion of the last pressing against the stretchable material such that the corresponding material-covered last portion extends below the insole periphery.

4. An article of footwear comprising:

an insole comprising a fore part and a rear part, the fore part and rear part each comprising a rigid periphery attached to a central area of stretchable central material;

an upper having a lower edge attached to the insole periphery;

an injection molded outsole, the upper outsole surface defined by the lower insole surface in combination with a last pressing against the stretchable material such that at last one portion of the material-covered last extends below the insole periphery to form a corresponding depression in the upper outsole surface; and a cushioned insert having at least one extension from its lower surface in a position corresponding to a depression, the extension deforming the stretchable material overlying that depression such that the extension is receivable within the depression.

5. A method of making an article of footwear, the method comprising the steps of:

providing an insole comprising a fore part and a rear part, the fore part and rear part each comprising a rigid periphery attached to a central area of stretchable material;

attaching a lower edge of an upper to the insole periphery;

positioning a last against the upper insole surface to define an upper surface for an injection molded outsole, at least one portion of the last pressing against the stretchable material such that the corresponding material-covered last portion extends below the insole periphery;

injection molding an outsole;

removing the last, the at least one material-covered last portion extending below the insole periphery defining a corresponding depression in the upper surface of the molded outsole; and inserting a cushioned member having at least one extension from its lower surface in a position corresponding to a depression, the extension deforming the stretchable material overlying that depression such that the extension is receivable within the depression.

* * * * *